US006318960B1

(12) United States Patent
Kuwabara et al.

(10) Patent No.: US 6,318,960 B1
(45) Date of Patent: Nov. 20, 2001

(54) GAS TURBINE STATIONARY BLADE

(75) Inventors: Masamitsu Kuwabara; Yasuoki Tomita; Eisaku Ito, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/522,008

(22) Filed: Mar. 9, 2000

(30) Foreign Application Priority Data

Jun. 15, 1999 (JP) ..... 11-168492

(51) Int. Cl.[7] ..... F01D 5/14
(52) U.S. Cl. ..... 415/115
(58) Field of Search ..... 415/115, 117; 416/97 R

(56) References Cited

U.S. PATENT DOCUMENTS 4,770,608 * 9/1988 Anderson et al. ..... 416/97 R
5,120,192 6/1992 Ohtomo et al. ..... 415/115
5,193,980 * 3/1993 Kaincz et al. ..... 416/97 R
5,281,084 * 1/1994 Noe et al. ..... 415/115
5,374,162 * 12/1994 Green ..... 416/97 R
5,538,394 * 7/1996 Inomata et al. ..... 416/97 R
5,577,889 * 11/1996 Terazaki et al. ..... 416/97 R
5,779,437 * 7/1998 Abel-Messeh et al. ..... 415/115
5,813,835 * 9/1998 Corsmeier et al. ..... 416/97 R
5,931,638 * 8/1999 Krause et al. ..... 416/97 R
6,036,441 * 3/2000 Manning et al. ..... 416/97 R

* cited by examiner

*Primary Examiner*—John E. Ryznic
(74) *Attorney, Agent, or Firm*—Wenderoth, Lind & Ponack, L.L.P.

(57) ABSTRACT

A gas turbine stationary blade having passages (23, 24) that are provided in the stationary blade (10). A front cylindrical insert (2) is provided in the passage (23) and a rear cylindrical insert (5) is provided in the passage (24), and the inserts are supported at two supporting portions (3*a,* 3*b*), (6*a,* 6*b*), respectively. A projection (1) is provided at a leading edge portion of the blade so that the leading edge, where the thermal loads are high, is made smaller in size and the number of rows of cooling holes (11*a*) in the leading edge portion is reduced. Air blowing holes (4*b*) are provided on the dorsal side rear portion of the front insert (2) and film cooling holes (12) are provided on the dorsal side of the blade, both have diameters that are larger than other air blowing and cooling holes provided in the insert (2) and the blade (10), so that dust in the cooling air is caused to flow out, thereby preventing clogging of the holes. The curved surface of the blade leading edge portion is formed on an elliptical curve, so that the cooling air is caused to flow smoothly. Also, curved surfaces of fillets are formed on an elliptical curve so that thermal stresses concentrated near the fillets are avoided.

12 Claims, 4 Drawing Sheets

GAS TURBINE STATIONARY BLADE

BACKGROUND OF THE INVENTION

1. Field of the Invention

The present invention relates generally to a gas turbine stationary blade, and more particularly, to a gas turbine stationary blade structured such that the shape of the blade leading edge is improved so as to blow a blade cooling air with an enhanced efficiency, a thermal stress concentration is avoided and a blade assembling is facilitated.

2. Description of the Prior Art

FIG. 6 is a cross sectional view showing a representative first stage stationary blade of a prior art gas turbine. In FIG. 6, numeral 20 designates a first stage stationary blade, numeral 21 designates an outer shroud and numeral 22 designates an inner shroud. Numerals 20*a*, 20*b*, 20*c*, 20*d*, 20*e* designate cooling air holes, respectively, wherein the holes 20*a* are provided in the blade leading edge, the holes 20*b* in the blade trailing edge, the holes 20*c* in the blade leading edge portion, the holes 20*d* in the blade central portion and the holes 20*e* in the blade trailing edge portion. Within the stationary blade 20, there are provided a passage 23 in the blade leading edge portion, a passage 24 in the blade central portion and a passage 29 in the blade trailing edge portion. An insert 25 is inserted into the passage 23 and an insert 26 is inserted into the passage 24. The inserts 25, 26 are provided in the passages 23, 24, respectively, with predetermined spaces being maintained from inner wall surfaces of the respective passages 23, 24 and are supported at a multiplicity of points. Both of the inserts 25, 26 are made in hollow cylindrical members and a multiplicity of air blowing holes 27, 28 are bored in and around entire walls of the inserts 25, 26, respectively.

In the above mentioned first stage stationary blade, cooling air 30, 31, 32 is led into the stationary blade 20 from a turbine casing space (not shown) through the outer shroud 21, wherein the cooling air 30 flows into the insert 25 on the leading edge side and then flows out of the air blowing holes 27 of the insert 25 into a space formed between an inner wall of the passage 23 and an outer wall of the insert 25 to effect an impingement cooling of the inner wall of the passage 23. The cooling air 30 then flows out of the cooling air holes 20*c* bored in the blade and onto an outer surface of the blade to effect shower head cooling and film cooling of the blade outer surface.

The cooling air 31 likewise flows into the insert 26 and then flows out of the air blowing holes 28 of the insert 26 into a space formed between an inner wall of the passage 24 and an outer wall of the insert 26 to effect the impingement cooling of the inner wall of the passage 24. The cooling air 31 then flows out of the cooling air holes 20*d* bored in the blade and onto the outer surface of the blade to effect film cooling of the blade outer surface. Also, the cooling air 32 flows into the passage 29 on the trailing edge side to cool a rear portion of the blade and flows out of the cooling air holes 20*e* of the blade trailing edge portion and onto the outer surface of the blade to effect film cooling thereof.

In the first stage stationary blade as described above, there occurs a non-uniformity of outflow air at the blade;s leading edge which causes an irregularity in the air flow velocity. This often results in an increased pressure loss or a back flow of the cooling air. There also occurs a clogging of the air blowing holes of the insert within the blade due to dust in the cooling air. This results in an increased pressure loss. Also, when the insert is to be assembled into the blade, there are a multiplicity of points to fix the insert in the air passage.

Since the work space is narrow, assembling errors are more common and a lot of time is required for assembling the insert. Further, in terms of thermal stress, portions of the blade which are connected to the outer shroud and the inner shroud are structured so as to have only small fillet curves. As a result, thermal stress may concentrate in these areas and cause cracks. Thus, for a gas turbine that is operated at a higher temperatures, it is strongly desired to solve the above mentioned problems in order to enhance a reliability of the stationary blade.

SUMMARY OF THE INVENTION

It is therefore an object of the present invention to provide a gas turbine stationary blade having an improved structure in which the air flows smoothly out of the blade's interior onto a curved surface of the blade's leading edge, film cooling holes through which the air flows out are prevented from clogging, inserts that are supported by simple supporting structures and fillet curves at the blade's connecting portions that are formed so as not to cause thermal stresses, thereby cooling efficiency of the blade is enhanced, assembly of the blade is facilitated and reliability of the stationary blade is improved.

In order to achieve the above objectives, the following (1) to (8) aspects of the present invention are provided hereinbelow:

(1) A gas turbine stationary blade is constructed of a blade that is fixed to an outer shroud and an inner shroud, wherein cooling air flows in the blade for cooling thereof. A projection is provided on a portion of a leading edge portion of the blade. The projection has a smooth curved surface as well as a plurality of cooling holes through which the cooling air is blown.

(2) A gas turbine stationary blade as mentioned above in the first aspect of the invention, characterized in that the projection has a curved surface formed as an elliptical curve on an ellipse long axis.

(3) A gas turbine stationary blade as mentioned above in the first aspect of the invention, characterized in that the projection is projecting from the leading edge of the blade.

(4) A gas turbine stationary blade as mentioned above in the first aspect of the invention, characterized in that the leading edge of the blade has a curved surface formed to an elliptical curve on an ellipse long axis.

(5) A gas turbine stationary blade constructed such that the blade is fixed to an outer shroud and an inner shroud, and a plurality of passages are provided in the blade. Each of the passages receives a cylindrical insert, which includes a multiplicity of air blowing holes, to be fixed therein with a predetermined space maintained from an inner wall of each of the passages. The air blowing holes of the insert provided on a leading edge side of the blade include a first group and a second group. Each hole of the first group has a diameter larger than that of each hole of the second group. The first group of the air blowing holes is provided in a dorsal side rear portion of the insert. Also, a plurality of cooling holes, each of which has a diameter that is larger than other cooling holes in the blade, are provided in a dorsal portion of the blade near the first group of air blowing holes formed in the insert.

(6) A gas turbine stationary blade as mentioned above in the fifth aspect of the invention, characterized in that the insert in each of the passages is supported at two places.

(7) A gas turbine stationary blade as mentioned above in any one of the six aspects of the present invention, characterized in that fillets connect portions of the blade to the outer shroud and the inner shroud have curved surfaces formed as an elliptical curve on an ellipse short axis.

(8) A gas turbine stationary blade constructed such that a blade is fixed to an outer shroud and an inner shroud, and a plurality of passages are provided in the blade. Each of the passages receives a cylindrical insert, which includes a multiplicity of air blowing holes, to be fixed therein with a predetermined space maintained from an inner wall of each of the passages. A leading edge of the blade has a curved surface formed on an elliptical curve on a major axis of the ellipse. A projection formed at the leading edge portion of the blade and is located on the camber line of the blade. The projection has a curved surface formed on an elliptical curve on a major axis of the ellipse as well as a plurality of cooling holes through which cooling air can be blown. Fillets which connect portions of the blade to the outer shroud and the inner shroud have curved surfaces formed on an elliptical curve on a minor axis of an ellipse. The insert in each of the passages is supported at two places. The air blowing holes of the insert provided on a leading edge side of the blade include a first group and a second group. Each hole of the first group has a diameter that is larger than that of each hole of the second group. The first group of air blowing holes is provided in a dorsal side rear portion of the insert. Cooling holes, each having a diameter larger than other cooling holes provided in the blade, are provided in a dorsal portion of the blade near the first group of air blowing holes.

In the first aspect of the present invention, as described above in item (1), the leading edge portion of the blade, where there is especially a large thermal load, can be made smaller in size. In the prior art, the blade leading edge portion has a substantially circular shape and cooling holes through which cooling air is blown are arranged in plural rows in this portion. However, in the present invention, as mentioned above, the leading edge portion or projection has a smooth curved surface where the thermal load is high and this portion of the blade is made smaller, and thereby the number of rows of the cooling holes can be reduced as well. In the second aspect of the present invention, as described above in item (2), the curved surface of the leading edge portion is formed on an elliptical curve on a major axis of an ellipse so that the leading edge portion may be made smaller in size and the cooling air may flow out more effectively, and thereby this portion of the blade can be cooled concentrically. As a result the blade's leading edge, where the thermal load is especially high, can be effectively cooled.

Further, the curved surface of the blade's leading edge is formed on an elliptical curve on a major axis of an ellipse and the cooling air flowing out of the cooling holes does not become turbulent on the blade dorsal side. The cooling air flows smoothly along the curved surface of the blade dorsal portion, and thereby effective film cooling becomes possible.

Further, in case where fine dust contained in the cooling air flows out of the air blowing holes of the insert and causes clogging, the air blowing holes in the dorsal side rear portion of the insert, where dust may easily stagnate, are made larger than the other holes in the insert. Also, the diameters of the cooling holes of the blade near the larger air blowing holes are also made larger, such that dust in the insert is caused to flow out of the air blowing holes and the cooling holes more easily. Hence, there occurs no clogging of the air blowing holes of the insert or the cooling holes of the blade due to dust. As a result, cooling of the outer surface of the blade is remarkably enhanced. In the present invention, the insert in each of the passages is supported only at two places as compared with the prior art stationary blades in which the inserts are supported at several points. As a result, the positioning of the insert during assembly is facilitated. In addition the man-hours required to assemble the blade are reduced and the fitting accuracy is enhanced, which results in an enhanced reliability of the blade.

In the present invention, the fillets of the blade are formed on an elliptical curve, and thus eliminating the small curve of the prior art fillet, and hence the concentration of thermal stress does not occur at the blade connecting portions and the occurrence of cracks can be prevented.

Furthermore, in the present invention, the stationary blade is constructed to have all of the features set forth above in items (1) to (7), hence all of the mentioned effects of the inventions are exhibited, that is, the cooling effect is remarkably enhanced, the clogging of the insert holes is prevented, and the influence of the thermal stress is eliminated. Further, the assembling accuracy is enhanced, and thereby a stationary blade having enhanced reliability can be realize.

DESCRIPTION OF THE PREFERRED EMBODIMENTS

Figure 1:
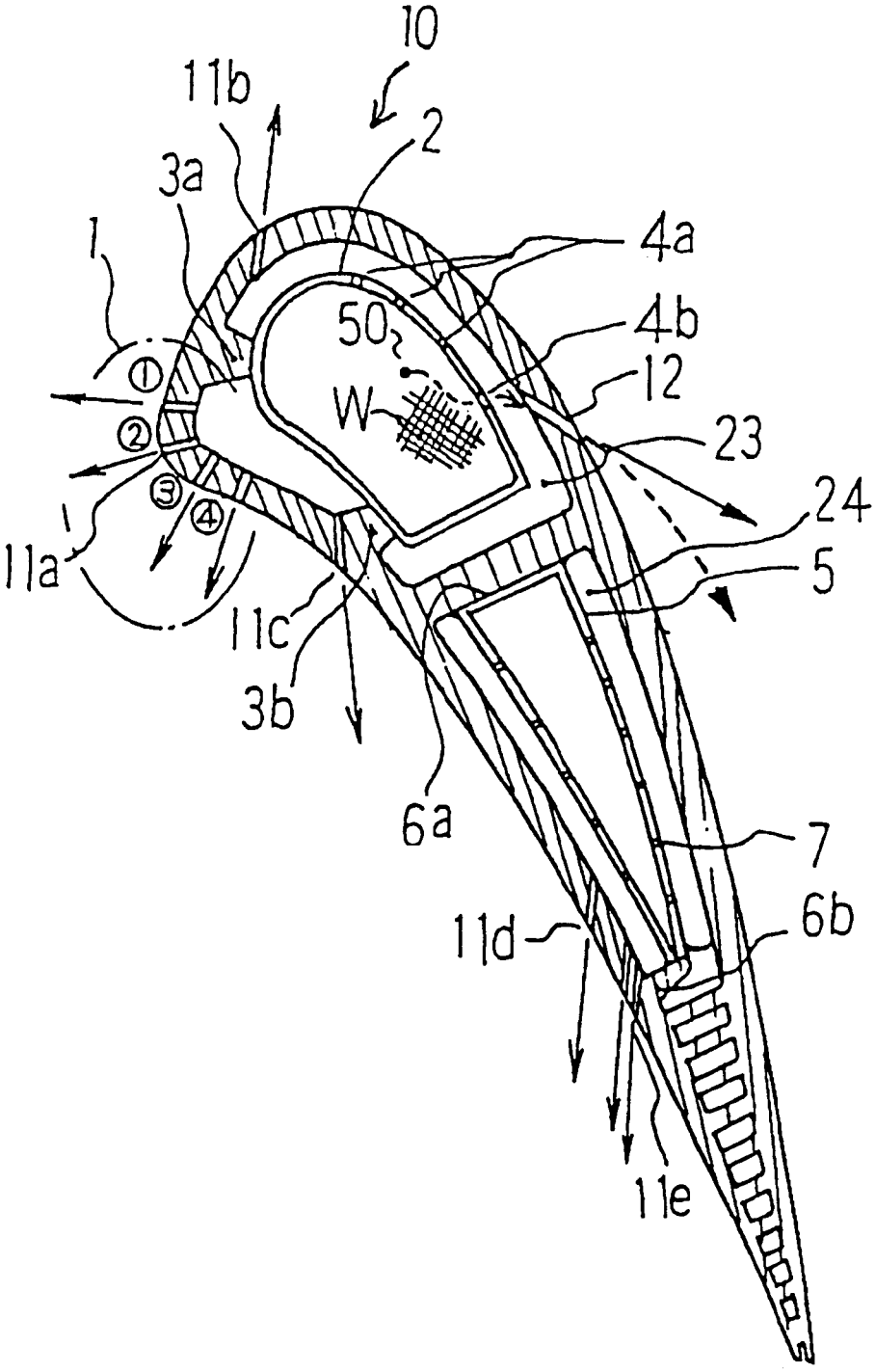
FIG. 1 is a cross sectional view of a gas turbine stationary blade constructed in accordance with an embodiment of the present invention.

Herebelow, exemplary embodiments according to the present invention will be described in detail with reference to FIGS. 1 through 5. FIG. 1 is a cross sectional view of a gas turbine stationary blade, especially a first stage stationary blade, of one embodiment according to the present invention. In FIG. 1, numeral 10 designates a stationary blade and numeral 1 designates a leading edge portion of the blade. The leading edge portion 1 is formed so as to have a smooth curved surface. In the stationary blade 10, like in the prior art case, there are provided passages 23, 24. A front insert 2 is inserted into the passage 23 and a rear insert 5 is inserted into the passage 24. Each of the inserts 2, 5 are fixedly supported at two points as will be described later. The front insert 2 is a hollow cylindrical member having a multiple air blowing holes 4*a*, 4*b*. The air blowing holes 4*a* are arranged in rows, and each row extends linearly in a blade height direction and has fifteen (15) holes, although not illustrated. Also, each hole 4*a* has a hole diameter 0.5 mm. Also, the air blowing holes 4*b* are arranged in a row, having sixteen 16 holes. The row of air blowing holes 4*b* extends linearly in the blade height direction and a hole diameter of each holes 4*b* is 0.6 mm, which is slightly larger than that of the air blowing holes 4*a*.

Within the passage 23, insert supporting portions 3*a*, 3*b* are formed at two places so as to project from an inner wall of the passage 23. The front insert 2 is supported and fixed at two points by the insert supporting portions 3*a*, 3*b* so that a predetermined space is maintained between an inner wall of the passage 23 and front insert 2.

The rear insert 5 is also a hollow cylindrical member having therearound a plurality of air blowing holes 7. The air blowing holes 7 are arranged in rows, having 20 holes each, extending linearly in the blade height direction on a dorsal side of the rear insert 5 and in two front rows, having 10 holes each, and in three rear rows, having 15 holes each, all extending linearly in the blade height direction on a ventral side of the rear insert 5. Each of these air blowing holes 7 has a hole diameter of 0.5 mm. The rear insert 5 is supported and fixed at two points. That is, a front portion of the rear insert 5 is supported by an insert supporting portion 6*a* of a rib provided in the blade extending between a dorsal side and a ventral side thereof. A rear portion of the rear insert 5 is supported by an insert supporting portion 6*b* projecting from the inner wall of the passage 24. A predetermined space is maintained between an inner wall of the passage 24 and the rear insert 5.

In the projection 1 of the stationary blade 10, there are provided shower head cooling holes 11*a* in four rows of ① to ④ that extend linearly in the blade height direction, wherein row ① has 21 holes, row ② has 20 holes, row ③ has 21 holes and row ④ has 20 holes. The diameter of each of the shower head cooling holes 11*a* is 0.5 mm. Also, in a leading edge portion of the blade, in addition to the shower head cooling holes 11*a*, there are provided film cooling holes 11*b*, 11*c* formed in respective rows, having 19 holes each and extending linearly in the blade height direction. The diameter of each of these film cooling holes 11*b*, 11*c* is 0.5 mm. Also, in a blade trailing edge portion, there are provided film cooling holes 11*d*, 11*e*, wherein the film cooling holes 11*d* are in a row, having 19 holes, and the film cooling holes 11*e* are in rows, having 20 holes each, all extending linearly in the blade height direction.

Further, in a blade dorsal portion, there are provided film cooling holes 12 in a row, having 16 holes and, wherein the hole diameter of each of the film cooling holes 12 is 0.6 mm. As compared with other cooling holes described above the hole diameter of 0.6 mm is slightly larger. In addition, the number of holes is smaller than 16. As a result, the outflow quantity of air through the film cooling hole 12 may not become excessive as compared with the other cooling holes. The film cooling holes 12 are positioned to correspond to an area W where air pressure is relatively low in the passage 23 or in the front insert 2. This area W is a place where dust contained in the air are likely to stagnate. The film cooling holes 12 are holes through which the dust is caused to flow out together with the air, as will be described later.

In the first stage stationary blade constructed as mentioned above, the projection 1 has a curved surface formed on an elliptical curve on an ellipse long axis, as described later, and the shower head cooling holes 11*a* are provided in the four rows ① to ④ in the projection 1. In the prior art, there are provided shower head cooling holes in five rows in this portion. According to the present invention, the projection 1, which is formed of an ellipse curve surface, is provided in the portion where there is a large thermal stress. As a result, the leading edge of the blade may be made smaller in size so that the number of holes arranged there as well as the air quantity flowing there may be lessened, thereby producing a better outflow of air.

Also, in the prior art dust contained in the air in the front insert 2 would stagnate in the area W where air pressure is comparatively low and enter the air blowing holes 4*a*, 4*b* in a dorsal portion of the front insert 2. This may cause clogging and insufficient cooling. However, in the present invention, the air blowing holes 4*b* in the dorsal side rear portion of the front insert 2 and the film cooling holes 12 of the blade 10, both near the area W, are formed so as to have their diameters larger than those other holes, and thus, dust 50 contained in the cooling air flows into the space between the front insert 2 and the inner wall of the passage 23 through the air blowing holes 4*b* and further flows outside through the film cooling holes 12, as shown by broken lines in FIG. 1. Thus, there occurs no clogging of the cooling air holes and the film cooling holes.

Further, the front insert 2 is supported at two insert supporting portions 3*a*, 3*b* that project from the inner wall of the blade 10. The rear insert 5 is also supported at two points by the insert supporting portion 6*a* of the rib that partitions the passages 23, 24 and the insert supporting portion 6*b* that projects in the blade trailing edge, as described above. Thus, when the blade is assembled, the insertion, and positioning of inserts 2, 5 into passages 23, 24 is simplified. Also, the inserts 2, 5 are more accurately assembled.

Figure 2:
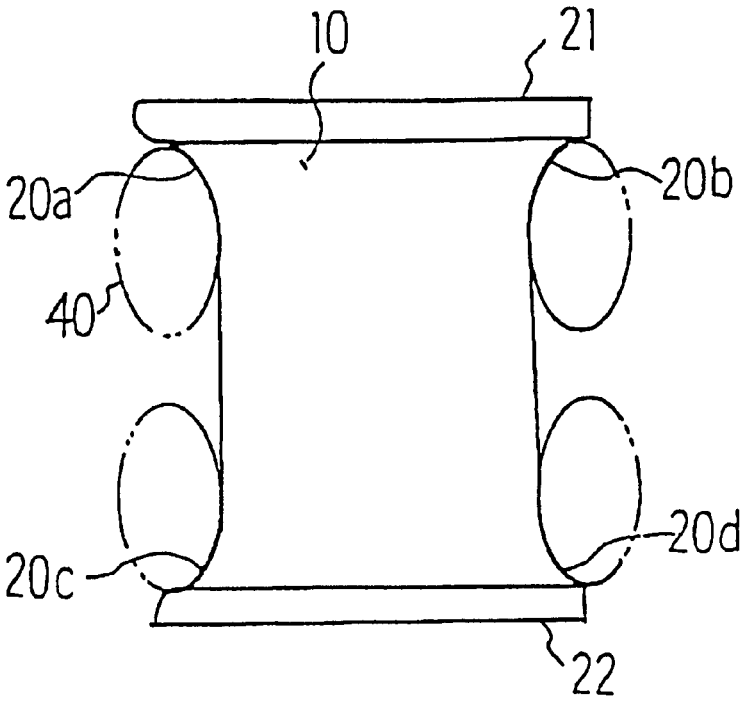
FIG. 2 is a side view of the stationary blade shown in FIG. 1, showing shapes of fillets therein.

FIG. 2 is a side view of the stationary blade of the embodiment mentioned above to show shapes of fillets therein. In FIG. 2, a fillet 20*a* of the leading edge portion of the blade and a fillet 20*b* of the blade trailing edge portion, both connecting at a portion of the blade 10 to the outer shroud 21, have curved surfaces of an elliptical shape 40, respectively. Likewise, fillet 20*c* of the leading edge portion and a fillet 20*d* of the blade trailing edge portion, both at a connecting a portion of the blade 10 to the inner shroud 22, have curved surfaces of an elliptical shape. The fillets have curved surfaces in the form of an elliptical curve on an ellipse short axis. There occurs no such concentration of the thermal stress as caused by small fillet curves in the prior art, and the occurrence of cracks due to thermal stress can be suppressed.

Figure 3A:
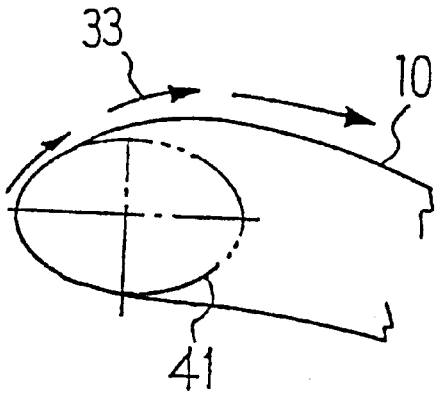
FIG. 3(*a*) is a schematic view showing the shape of a leading edge portion of the stationary blade shown in FIG. 1, and FIG. 3(*b*) shows that of the prior art.
Figure 3B:
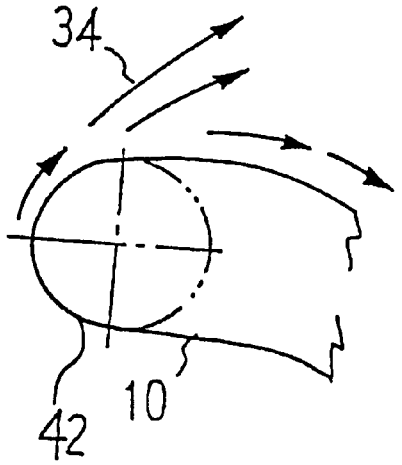
Fig. 3(b) (Prior Art)

FIG. 3(*a*) is a schematic view showing a shape of the blade leading edge portion of the above-mentioned embodiment, wherein FIG. 3(*a*) shows the shape of the present invention and FIG. 3(*b*) shows that of the prior art. In FIG. 3(*b*) the leading edge of the blade has a curved surface of a circular shape 42, and while cooling air 34, which flows out of a blade interior, flows along the curved surface of the blade leading edge, a portion of the cooling air 34 does not flow along the curved surface but becomes turbulent. However, in the blade of the present invention as shown in FIG. 3(*a*), the leading edge of the blade has a curved surface of an elliptical shape 41, and cooling air 33, which flow out of the blade interior flows smoothly along the elliptical curved surface toward the blade dorsal portion. Thus, there is no turbulence of the air and the cooling effect can be enhanced.

Figure 5:
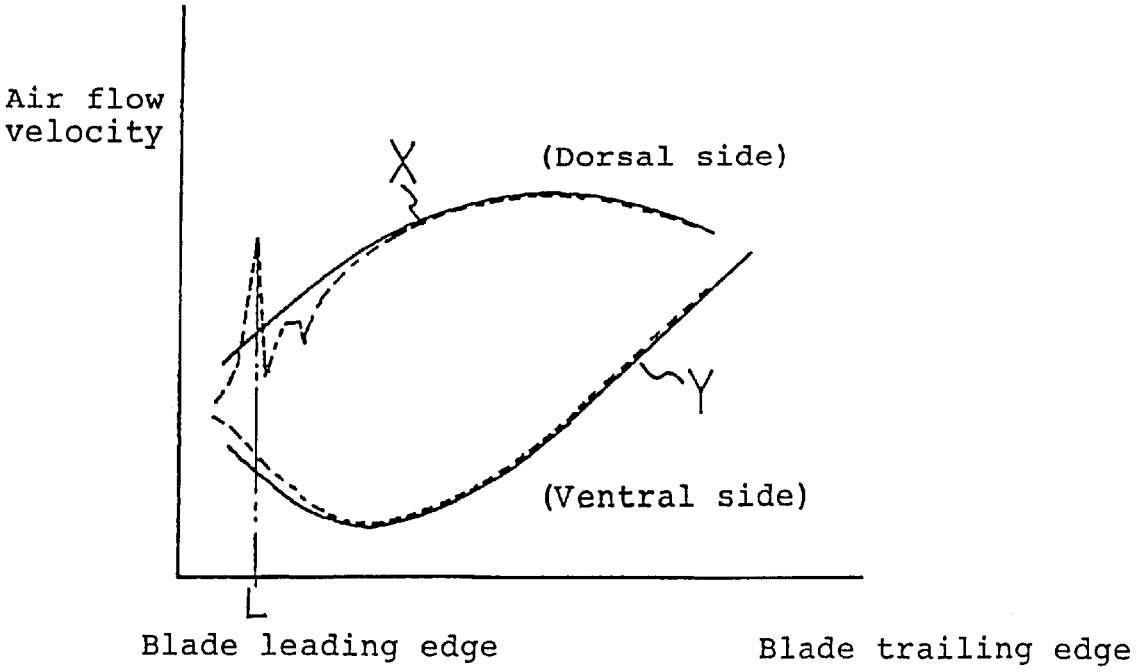
FIG. 5 is a graph showing a cooling air flow velocity in the gas turbine stationary blade of the embodiment shown in FIG. 1.
Figure 6:
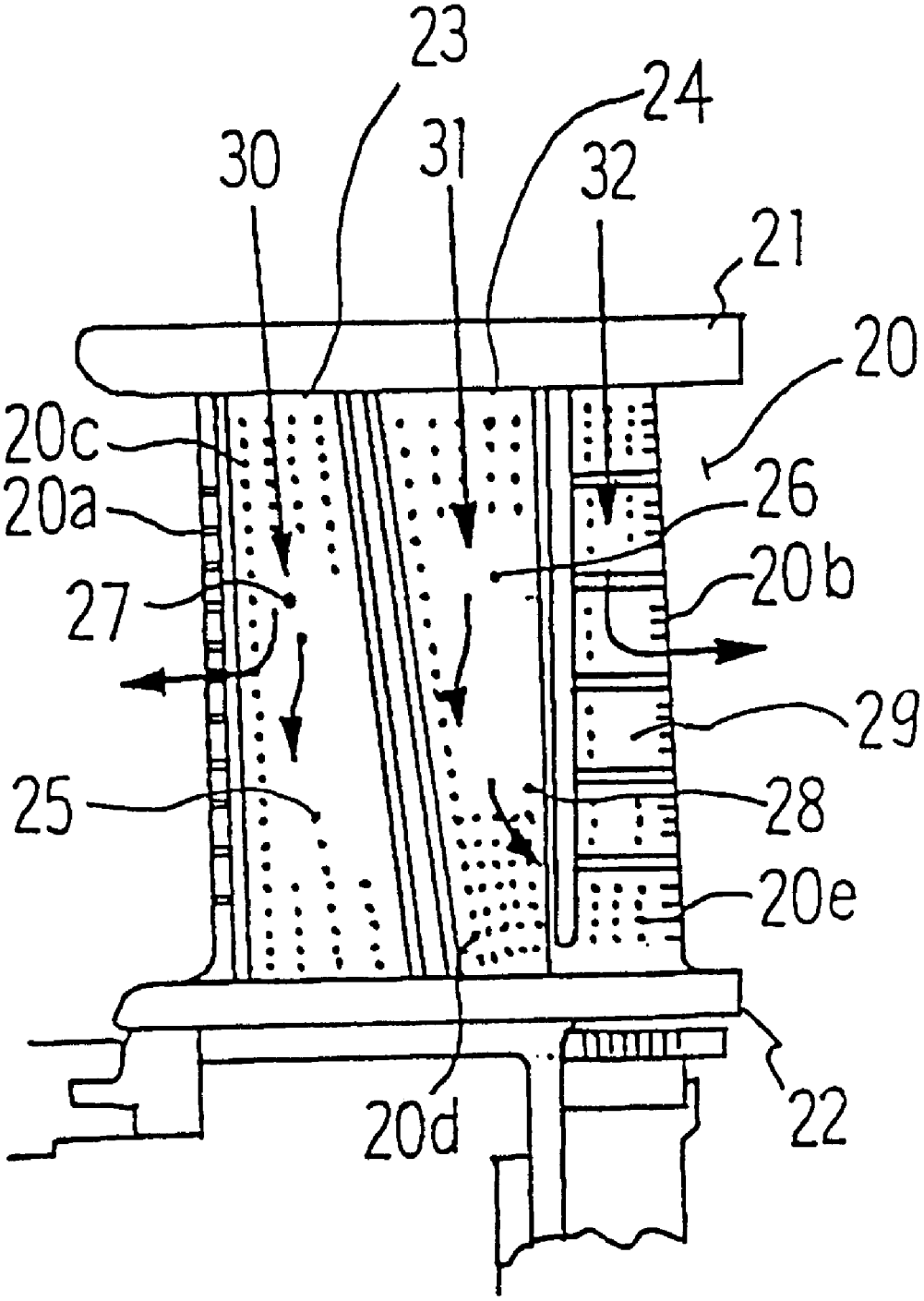
Fig. 6 (Prior Art)
FIG. 6 is a cross sectional view showing a representative first stage stationary blade of a prior art gas turbine.

In FIG. 5, flow velocity of the cooling air according to positions of the blade is shown in comparison of the leading edge of the prior art circular shape and that of the elliptical shape of the present invention, wherein X shows the air flow velocity of the blade dorsal side and Y shows that of the blade ventral side. Also, solid lines show a flow velocity pattern of the blade of the elliptical shape of the present invention and broken lines show that of the blade of the circular shape. As shown in FIG. 5, on the blade dorsal side in the prior art case, there arises a velocity spike at the position shown by L where the air flow velocity varies and the cooling air does not flow smoothly, but in the elliptically curved leading edge of the present invention, there occurs no such velocity spike.

Figure 4:
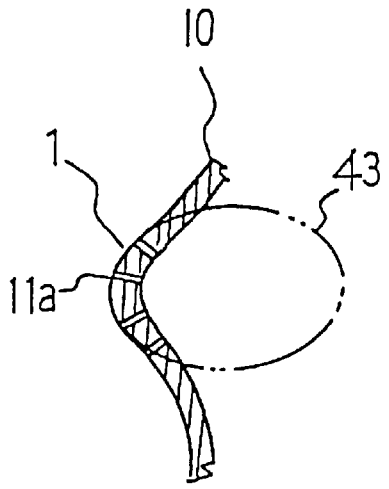
FIG. 4 is a detailed view of a projection of a blade leading edge portion of the embodiment shown in FIG. 1.

FIG. 4 is a detailed view of the projection 1 of the blade leading edge shown in FIG. 1. The projection 1 has a curved surface of a circular shape or an elliptical shape, wherein the elliptical shape is more preferable. In FIG. 4, the curved surface is formed on an elliptical curve at the major axis of ellipse 43. The projection 1 is formed as an elliptical curve, thereby the leading edge of the blade, where there is a large thermal load, can be made smaller in size. As a result, the number of shower head cooling holes 11*a* are reduced as compared with the prior art. That is, in the leading edge of the blade of the prior art circular shape, the shower head cooling holes are provided in five rows, but in the present embodiment, the leading edge of the blade where the thermal load is large is made smaller and the shower head cooling holes may be provided in four rows. The projection 1 is formed so as to project from the portion of the leading edge of the blade where the thermal load is large, as shown in FIG. 1, and thereby a high cooling effect can be obtained.

As described above, in the gas turbine stationary blade of the present embodiment: (1) the front and rear inserts 2, 5 in the passages 23, 24 are supported at two points, respectively, and a structure that facilitates assembly of the front and rear inserts 2, 5 is realized, (2) the air blowing holes 4*b* of the front insert 2 and the film cooling holes 12 provided in the blade dorsal portion near the air blowing holes 4*b*, both having diameters that are larger than other air blowing and cooling holes, and thus, the dust in the air is caused to flow out and clogging of the air blowing holes and the shower head or film cooling holes is prevented, (3) the leading edge of the blade is formed so as to have the curved surface of an elliptical shape and the cooling air flow is smooth and non-turbulent; (4) the projection 1 projects from the blade leading edge where there are large thermal loads, as a result, the leading edge of the blade is made smaller, and thus, the number of rows of shower head cooling holes 11*a* can be reduced, (5) the projection 1 is formed so as to project from the portion of the blade leading edge and the cooling effect is enhanced, and (6) the fillets which connect portions of the blade to the outer shroud, and the inner shroud are formed along an elliptical shape, thereby avoiding thermal stress concentration. Thus, by all these improvements mentioned in (1) to (6) above, reliability of the gas turbine first stage stationary blade is enhanced remarkably.

It is to be noted that the constructions mentioned in (1) to (6) above may be applied individually or in partial combination thereof, and if all of (1) to (6) above are applied, then the reliability of the stationary blade can be enhanced further.

It is understood that the invention is not confined to the particular construction and arrangement of parts herein illustrated and described but embraces such modified forms thereof which come within the scope of the appended claims.

What is claimed is:

1. A gas turbine stationary blade assembly constructed such that a blade is fixed to an outer shroud and an inner shroud and a plurality of passages are provided in the blade, a generally cylindrical insert being inserted in each of said passages so that a predetermined spacing is maintained from an inner wall of the respective passage, wherein each of the inserts has a multiplicity of air blowing holes and one of the inserts is provided on a leading edge side of the blade and includes a first group of air blowing holes and a second group of air blowing holes, wherein each hole of the first group of air blowing holes has a diameter that is larger than each hole of the second group of air blowing holes, and the first group of air blowing holes is provided in a dorsal side rear portion of the insert that is located at the leading edge side of the blade, and wherein a plurality of cooling holes are provided in the blade, each of the cooling holes that are provided in a dorsal portion of the blade, near said first group of the air blowing holes, has a diameter that is larger than the other cooling holes.

2. A gas turbine stationary blade assembly as claimed in claim 1, wherein each of the inserts is supported at only two places in the respective passage.

3. A gas turbine stationary blade as claimed in claim 2, wherein a plurality of fillets connect the blade to the inner shroud and the outer shroud, and each of the fillets has a curved surface defined by a portion of an elliptical curve at an ellipse short axis.

4. A gas turbine stationary blade as claimed in claim 1, wherein a plurality of fillets connect the blade to the inner shroud and the outer shroud, and each of the fillets has a curved surface defined by a portion of an elliptical curve at an ellipse short axis.

5. A gas turbine stationary blade assembly constructed such that a blade is fixed to an outer shroud and an inner shroud and a plurality of passages are provided in the blade, a generally cylindrical insert being inserted in each of said passages so that a predetermined spacing is maintained from an inner wall of the respective passage, wherein each of said inserts has a multiplicity of air blowing holes, wherein a leading edge of the blade has a curved surface formed on an elliptical curve at an ellipse long axis, and wherein the leading edge portion of the blade defines a projection having a curved surface formed on an elliptical curve at an ellipse long axis, the projection having a plurality of cooling holes, a plurality of fillets connecting portions of the blade to the outer shroud and the inner shroud, each of the fillets having curved surfaces formed on an elliptical curve at an ellipse short axis, wherein each of the inserts is supported at two locations in the respective passage, and one of the inserts is provided on a leading edge side of the blade and includes a first group of air blowing holes and a second group of air blowing holes, wherein each hole of said first group of the air blowing holes has a diameter that is larger than each hole of said second group of the air blowing holes, and the first group of air blowing holes is provided in a dorsal side rear portion of the insert in the leading edge side of the blade, and a plurality of cooling holes are provided in the blade, each of the cooling holes provided in a dorsal portion of the blade near said first group of the air blowing holes has a diameter that is larger than the other cooling holes.

6. A gas turbine stationary blade comprising:

a blade section having a surface defined by a first portion and a second portion;

a first passage provided in a leading edge side of said blade section;

a second passage provided in a trailing edge side of said blade section;

a first insert mounted in said first passage, said first insert having a plurality of air blowing holes defining a first group of air blowing holes and a second group of air blowing holes, wherein said air blowing holes of said first group are provided in a dorsal side rear portion of said first insert and have larger diameters than said air blowing holes of said second group;

a second insert mounted in said second passage; and a plurality of cooling holes provided in said first and second surface portions of said blade, wherein said first surface portion is located near said first group of air blowing holes, and each of said cooling holes provided in said first surface portion has a diameter that is larger than said cooling holes provided in said second surface portion.

7. A gas turbine stationary blade as claimed in claim 6, wherein said first insert is supported at only two places in said first passage.

8. A gas turbine stationary blade as claimed in claim 7, wherein said second insert is supported at only two places in said second passage.

9. A gas turbine stationary blade as claimed in claim 6, further comprising fillets connecting said blade to an inner shroud and an outer shroud, each of said fillets having a curved surface defined by a portion of an elliptical curve at an ellipse short axis.

10. A gas turbine stationary blade as claimed in claim 6, wherein said leading portion defines a projection having a curved surface defined by an elliptical curve on an ellipse short axis.

11. A gas turbine stationary blade assembly comprising:

a blade disposed between an inner shroud and an outer shroud;

a plurality of fillets connecting said blade to said inner and outer shrouds, wherein each of said fillets has a curved surface defined by a portion of an elliptical curve at an ellipse short axis;

a first passage provided in a leading edge section of said blade and a second passage provided in a trailing edge section of said blade;

a first insert mounted at only two places in said first passage, said first insert having a plurality of air blowing holes defining a first group of air blowing holes and a second group of air blowing holes, wherein each of said air blowing holes of said first group is provided in a dorsal side rear portion of said first insert and has a diameter that is larger than each of said air blowing holes of said second group; and a plurality of cooling holes provided in said blade, wherein a number of said cooling holes, which are located near said first group of air blowing holes of said first insert, each has a diameter that is larger than the other of said cooling holes, wherein a leading edge portion of said blade defines a projection having a curved surface that is defined by a section of an elliptical curve at an ellipse long axis.

12. A gas turbine stationary blade as claimed in claim 11, wherein a second insert having a plurality of air blowing holes is mounted at only two places in said second passage.

* * * * *